US011920232B2

(12) United States Patent
Liu et al.

(10) Patent No.: US 11,920,232 B2
(45) Date of Patent: Mar. 5, 2024

(54) TITANIUM ALLOY WITH A GRADIENT MICROSTRUCTURE AND PREPARATION METHOD THEREOF

(71) Applicant: Central South University, Hunan (CN)

(72) Inventors: Libin Liu, Hunan (CN); Di Wu, Hunan (CN)

(73) Assignee: Central South University, Changsha (CN)

( * ) Notice: Subject to any disclaimer, the term of this patent is extended or adjusted under 35 U.S.C. 154(b) by 43 days.

(21) Appl. No.: 17/691,521

(22) Filed: Mar. 10, 2022

(65) Prior Publication Data

US 2023/0018970 A1 Jan. 19, 2023

(30) Foreign Application Priority Data

Jul. 7, 2021 (CN) ..... 202110766164.5

(51) Int. Cl.

| | |
|---|---|
| ***C22F 1/18*** | (2006.01) |
| ***C22C 1/02*** | (2006.01) |
| ***C22C 14/00*** | (2006.01) |

(52) U.S. Cl.

CPC ..... *C22F 1/183* (2013.01); *C22C 1/02* (2013.01); *C22C 14/00* (2013.01)

(58) Field of Classification Search

None

See application file for complete search history.

(56) References Cited

U.S. PATENT DOCUMENTS

2010/0200123 A1* 8/2010 Kirkwood ..... C21D 1/613 72/352

OTHER PUBLICATIONS

Lei et al. "Microstructure characterization and nano & micro hardness of tri-modal microstructure of titanium alloy under different hot working conditions." Materials Characterization 134 (2017) 236-245. (Year: 2017).*

Gao et al. "Dependence of mechanical properties on the microstructural parameters of TA15 titanium alloy with tri-modal microstructure." Materials Science & Engineering A 739 (2019) 203-213 (Year: 2019).*

Nalla et al. "Influence of Microstructure on High-Cycle Fatigue of Ti-6AI-4V: Bimodal vs. Lamellar Structures." Metallurgical and Materials Transactions A. vol. 33A, Mar. 2002. pp. 899-918. (Year: 2002).*

* cited by examiner

*Primary Examiner* — Brian D Walck

(74) *Attorney, Agent, or Firm* — HoustonHogle LLP

(57) ABSTRACT

The disclosure relates to the technical field of alloys, and in particular to a titanium alloy with a gradient microstructure and a preparation method thereof. Two new gradient microstructures different from the existing microstructure in titanium alloy are designed for the first time by an ingenious three-step heat treatment scheme, specifically, the gradient lamellar microstructure and gradient tri-modal microstructure. Compared with the regular uniform lamellar microstructure, the titanium alloy with gradient lamellar microstructure can achieve the simultaneous improvement of strength and ductility. Compared with the regular bimodal microstructure, the strength of a titanium alloy with a gradient tri-modal microstructure can be increased by about 10%, and the ductility is slightly reduced.

8 Claims, 3 Drawing Sheets

TITANIUM ALLOY WITH A GRADIENT MICROSTRUCTURE AND PREPARATION METHOD THEREOF

CROSS REFERENCE TO RELATED APPLICATION

This patent application claims the benefit and priority of Chinese Patent Application No 202110766164.5, filed on Jul. 7, 2021, the disclosure of which is incorporated by reference herein in its entirety as part of the present application.

TECHNICAL FIELD

The present disclosure relates to the technical field of alloys, and in particular to a titanium alloy with a gradient microstructure and a preparation method thereof.

BACKGROUND ART

In recent years, metastable β titanium alloys such as Ti-55531 have attracted the attention of researchers because they have a lower density and a strength of more than 1200 MPa. Currently, they have been applied to large-thickness structural parts such as the main landing gear of large passenger aircraft such as Boeing-787 and Airbus A-380.

As we all know, the microstructure of the alloy is a key factor in determining the properties of the alloy. Uniform lamella microstructure is a typical microstructure of metastable β titanium alloys such as Ti-55531 alloy. The uniform lamella microstructure is composed of uniformly distributed a lamellae, and the α lamellae are distributed on the β matrix. The titanium alloy with this lamella microstructure can obtain high strength, but the ductility of the alloy is usually very poor (usually less than 6%). The reason for the low ductility of the uniform lamellar alloy is mainly due to the difficulty of deformation of the nano-sized α phase, and the low strength at the β grain boundary, and the material is easy to fracture at the β grain boundary. Another typical microstructure of Ti-55531 alloy is a bimodal microstructure, which is characterized by a spherical primary α phase and uniform lamellar α-phase, so it is called a bimodal microstructure. This kind of microstructure promotes the ductility of the material by introducing the spherical primary α phase, but sacrifices the strength of the material. The reason is that the strength of spherical primary α is low, and the interface strength between the primary α phase and the β matrix is weak, so the material is easily broken here.

Therefore, at present, the strength and ductility matching of titanium alloys is still a problem to be solved.

SUMMARY

In view of this, the present disclosure provides a titanium alloy with a gradient microstructure and a preparation method thereof. In the present disclosure, two new gradient microstructures different from the existing microstructure is regulated in titanium alloy for the first time, which can significantly improve the comprehensive performance of titanium alloy, and the strength and ductility of titanium alloy obtained are well matched.

In order to achieve the above purpose of the present disclosure, the present disclosure provides the following technical schemes:

A method for preparing a titanium alloy with a gradient microstructure, comprising the following steps:

successively subjecting a metastable β-type titanium alloy forgings to solution treatment, heat preservation treatment and aging treatment to obtain a titanium alloy with a gradient microstructure, wherein the temperature of the solution treatment is 20-100° C. below the α/β transition temperature of the metastable β-type titanium alloy, and the time is 30-120 min;

the temperature of the heat preservation treatment is 30-100° C. above the α/β transition temperature of the metastable β-type titanium alloy, and the holding time is less than or equal to 1.5 min or greater than 1.5 min and less than or equal to 10 min; and timing is started when the temperature of the metastable β-type titanium alloy is raised to the temperature of the heat preservation treatment; and when the holding time is less than or equal to 1.5 min, the gradient microstructure is a gradient tri-modal microstructure; and when the holding time is greater than 1.5 min and less than or equal to 10 min, the gradient microstructure is a gradient lamellar microstructure.

In some embodiments, the heat preservation treatment comprises the follow steps: directly placing the titanium alloy forgings after solution treatment at the temperature of the heat preservation treatment, and starting timing when the titanium alloy forgings is heated to the temperature of the heat preservation treatment.

In some embodiments, the heating rate of the titanium alloy forgings to the temperature of the heat preservation treatment is 200-2000° C./min.

In some embodiments, the temperature of the aging treatment is 400-680° C., and the time is 60-600 min.

In some embodiments, the metastable β-type titanium alloy in the metastable β-type titanium alloy forgings is Ti-55531 alloy, Ti-1023 alloy or β-21S alloy.

In some embodiments, the metastable β-type titanium alloy forgings is prepared by a method comprising the following steps:

mixing titanium alloy raw materials, smelting, casting and scalping to obtain titanium alloy ingots; and subjecting the titanium alloy ingots to a cogging forging and an α/β phase region forging in sequence to obtain the metastable β-type titanium alloy forgings, wherein the temperature of the cogging forging is 100-200° C. above the α/β transition temperature of the metastable β-type titanium alloy; and the temperature of the α/β phase region forging is 20-100° C. below the α/β transition temperature.

In some embodiments, the smelting method is vacuum consumable smelting, and the times of vacuum consumable smelting are at least 3 times.

In some embodiments, the times of the α/β phase region forging are at least 3 times.

The present disclosure also provides a titanium alloy with a gradient microstructure prepared by the preparation method described in above technical schemes, wherein the gradient microstructure is a gradient lamellar microstructure or a gradient tri-modal microstructure; the gradient lamellar microstructure is composed of coarse α lamella and ultra-fine α lamella; and the gradient tri-modal microstructure is composed of primary α phase, ultra-fine α phase and coarse α phase.

The present disclosure provides a method for preparing a titanium alloy with a gradient microstructure, wherein comprising the following steps: successively subjecting a metastable β-type titanium alloy forgings to solution treatment, heat preservation treatment and aging treatment to obtain a titanium alloy with a gradient microstructure, wherein the temperature of the solution treatment is 20-100° C. below the α/β transition temperature of the metastable β-type titanium alloy, and the time is 30-120 min; the temperature of the heat preservation treatment is 30-100° C. above the α/β transition temperature of the metastable β-type titanium alloy, and the holding time is less than or equal to 1.5 min or greater than 1.5 min and less than or equal to 10 min, and timing is started when the temperature of the titanium alloy forgings is raised to the temperature of the heat preservation treatment. In the research of Cu (copper) alloy, it is found that if a gradient material combining coarse and ultra-fine grains is formed in the alloy microstructure, a good match of strength and ductility can be achieved. Based on this, combined with the formation mechanism of the α-lamellae in the titanium alloy, two new gradient microstructures, different from the conventional microstructure, were firstly regulated in titanium alloy by an ingenious three-step heat treatment scheme. Specifically:

The first type is that when the holding time is greater than or equal to 1.5 min and less than 10 min, a gradient lamellar microstructure that is different from the conventional uniform lamellar microstructure is obtained. Its characteristics are as follows: it is composed of coarse α lamellae and ultra-fine α lamellae, in which the ultra-fine α lamellae are formed at the grain boundaries, which can strengthen the grain boundaries, and form coarse α lamellae within the grains, which can increase the deformability (coarse α lamella is more easily deformed than ultra-fine α lamella). Compared with the existing uniform lamellar microstructure, a titanium alloy with a gradient lamellar microstructure can achieve simultaneous improvement of strength and ductility.

The second type is when the holding time is less than or equal to 1.5 min, a gradient tri-modal microstructure that is different from the existing bimodal microstructure is obtained. Its characteristics are as follows: it is composed of spherical primary α phase, ultra-fine α phase and relatively coarse α phase. The ultra-fine α phase is distributed at the interface between the spherical α phase and the β matrix, which can strengthen the α phase and the β matrix interface. Compared with the regular bimodal microstructure, the strength of a titanium alloy with a gradient tri-modal microstructure can be increased by about 10%. Although the ductility is slightly decreased, it can also be maintained at more than 6.9%.

The present disclosure also provides a titanium alloy with a gradient microstructure prepared by the preparation method described in the above scheme. The titanium alloy with a gradient microstructure provided by the present disclosure has good strength and ductility matching and excellent comprehensive performance.

DETAILED DESCRIPTION OF THE EMBODIMENTS

Figure 1:
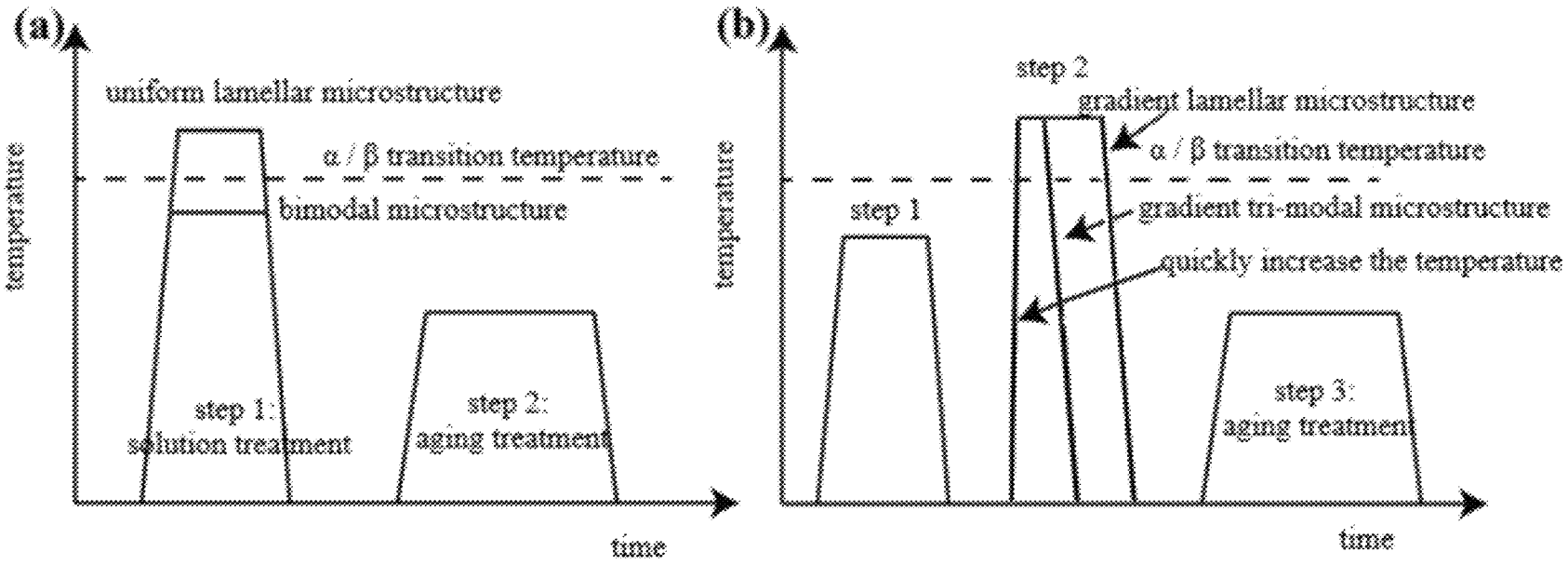
FIG. 1 is a schematic diagram of a conventional heat treatment process and the three-step heat treatment process of the present disclosure.

The present disclosure provides a method for preparing a titanium alloy with a gradient microstructure, wherein comprising the following steps:

successively subjecting a metastable β-type titanium alloy forgings to solution treatment, heat preservation treatment and aging treatment to obtain a titanium alloy with a gradient microstructure.

It should be understood that the heat preservation treatment actually refers to another solution treatment (which may be understood as the second solution treatment) after the solution treatment described herein (which may be understood as the first solution treatment).

The present disclosure has no special requirements on the type of the metastable β-type titanium alloy, and widely used commercial metastable β-type titanium alloys may be used. In a specific embodiment of the present disclosure, the metastable β-type titanium alloy is preferably Ti-55531 titanium alloy, Ti-1023 alloy or β-21S alloy, the composition of the Ti-55531 titanium alloy is Ti-5A1-5Mo-5V-3Cr-1Zr, and the α/β transition temperature is 840° C.; the composition of the Ti-1023 alloy is Ti-10V-2Fe-3A1, and the α/β transition temperature is 785° C.; and the composition of the β-21S alloy is Ti-15Mo-2.7Nb-3A1-0.2Si, and the α/β transition temperature is 810° C.

In the present disclosure, the metastable β-type titanium alloy forgings is preferably prepared by a method comprising the following steps:

mixing titanium alloy raw materials, smelting, casting and scalping to obtain titanium alloy ingots; and subjecting the titanium alloy ingots to a cogging forging and an α/β phase region forging in sequence to obtain the metastable β-type titanium alloy forgings.

It should be understood that the cogging forging refers to a forging performed in the β phase region, i.e. a primary forging, before the α/β phase region forging, and the α/β phase region forging refers to a forging preformed in the α/β two-phase region, i.e. a secondary forging.

In the present disclosure, the smelting method is vacuum consumable smelting, and the times of vacuum consumable smelting are preferably at least 3 times; the times of the α/β phase region forging are preferably at least 3 times. The cogging forging temperature is 100-200° C. above the α/β transition temperature of the metastable β-type titanium alloy, preferably 130-150° C. above the α/β transition temperature of the metastable β-type titanium alloy. The temperature of the α/β phase region forging is 20-100° C. below the α/β transition temperature of the metastable β-type titanium alloy, and preferably 30-60° C. below the α/β transition temperature of the metastable β-type titanium alloy. The present disclosure has no special requirements on other conditions and specific operation methods in the above preparation process, and the metastable β-type titanium alloy forgings can be obtained by using conditions well known to those skilled in the art.

After obtaining the metastable β-type titanium alloy forgings, the present disclosure subjects the metastable β-type titanium alloy forgings to solution treatment. In the present disclosure, the temperature of the solution treatment is preferably 20-100° C. below the α/β transition temperature of the metastable β-type titanium alloy, and more preferably 30-80° C. below the α/β transition temperature. The treatment time is preferably 30-120 min, more preferably 50-100 min, and timing is started from when the titanium alloy forgings is placed at the temperature of solution treatment.

In the specific embodiment of the present disclosure, the solution treatment is specifically as follows: placing the titanium alloy forgings at the temperature of solution treatment for 30-120 min, then quickly cooling to room temperature, and completing the solution treatment after cooling; the cooling method is preferably air cooling or water cooling, and more preferably air cooling. In the process of solution treatment, spherical primary α phase is obtained in the alloy, and the microstructure is composed of spherical primary α phase and β matrix.

After the solution treatment is completed, the present disclosure performs heat preservation treatment on the titanium alloy forgings after solution treatment. In the present disclosure, the temperature of the heat preservation treatment is 30-100° C. above the α/β transition temperature of the metastable β-type titanium alloy, preferably 50-80° C. above the α/β transition temperature of the metastable β-type titanium alloy; The holding time is preferably less than or equal to 1.5 min or greater than 1.5 min and less than or equal to 10 min, more preferably 0.5-1.5 min or 2-10 min, further preferably 0.8-1 min or 2-5 min; and timing is started from the time when the temperature of the titanium alloy forgings is raised to the temperature of the heat preservation treatment.

In the present disclosure, the heat preservation treatment specifically refers to directly placing the titanium alloy forgings after the solution treatment at the temperature of the heat preservation treatment, and timing is started when the titanium alloy forgings is heated to the temperature of the heat preservation treatment. In the present disclosure, the heating rate of the titanium alloy forgings is preferably 200-2000° C./min, more preferably 500-2000° C./min, and further more preferably 1000-1800° C./min. Specifically, depending on the size of the titanium alloy forgings, the heating rate is also different. If the size of the titanium alloy forgings is larger, the heating rate is slower, and if the size is smaller, the heating rate is faster. In the specific embodiment of the present disclosure, the faster the heating rate of the titanium alloy forgings, the better. Specifically, the size of the metastable β-type titanium alloy forgings used in the embodiment of the present disclosure is 68 mm×10 mm×3 mm. After it is placed at the temperature of the heat preservation treatment, the heating rate can reach 1000° C./min, and the temperature can be raised to the temperature of the heat preservation treatment within 1 min, and then the holding time is started to calculate, e.g. if the total treatment time at the temperature of the heat preservation treatment is 2 min, excluding the time for the titanium alloy to heat up (about 1 min), the remaining time is the holding time described in the above scheme; If the size of the metastable β-type titanium alloy forgings increases, its heating rate will decrease. When the heating rate is 200° C./min, and the temperature of the heat preservation treatment is 900° C., if the total treatment time at the temperature of the heat preservation treatment is 6 min, then the heating time (4.5 min) of the titanium alloy forgings is removed, and the holding time is 1.5 min.

After reaching the holding time, the present disclosure preferably quickly cools the titanium alloy forgings to room temperature; the cooling method is preferably air cooling or water cooling, and more preferably air cooling.

After the heat preservation treatment is completed, the present disclosure subjects the titanium alloy forgings after heat preservation treatment to aging treatment to obtain a titanium alloy with a gradient microstructure. In the present disclosure, the temperature of the aging treatment is preferably 400-680° C., more preferably 500-650° C., and the time of the aging treatment is preferably 60-600 min, more preferably 120-540 min, and timing is started when the titanium alloy is placed at the aging temperature.

After the aging treatment is completed, the present disclosure preferably quickly cools the titanium alloy to room temperature; the cooling method is preferably air cooling or water cooling, and more preferably air cooling.

In this field, the conventional uniform lamellar microstructure and bimodal microstructure are both obtained by two-step heat treatment of solution and aging. The heat treatment process is shown in panel (a) of FIG. 1. Specifically, the heat treatment method of conventional uniform lamellar microstructure is as follows: the metastable β-type titanium alloy forgings is subjected to solution treatment at 20-100° C. above the α/β transition temperature for 20-120 min, and then aged at 400-680° C. for 60-600 min; the conventional heat treatment method for the bimodal microstructure is as follows: the β-type titanium alloy forgings is subjected to solution treatment at 20-100° C. below α/β transition temperature for 20-120 min, and then aged at 400-680° C. for 60-600 min.

Compared with the conventional heat treatment process, the present disclosure adds heat preservation treatment step after the solution treatment, and obtains two different gradient microstructures according to the difference of the holding time. The heat treatment process of the present disclosure is shown in panel (b) of FIG. 1, the difference between the heat treatment scheme of conventional microstructure and gradient microstructure is mainly in step 2 (e.g. heat preservation treatment), which is characterized by: 1. The heating rate should be fast (the faster the better); 2. The holding time is short (the holding time of the gradient tri-modal microstructure is less than or equal to 1.5 min, the holding time of the gradient lamellar microstructure is greater than 1.5 min and less than or equal to 10 min). The present disclosure combines the principle of the phase transition of the microstructure of the titanium alloy to design the three-step heat treatment scheme, and obtains the gradient microstructure. The specific design principles are as follows:

The inventor found that the microstructure of the titanium alloy forgings after solution treatment is composed of a spherical primary α phase and a β matrix. When the temperature of the alloy quickly rises above the α/β transition temperature, the spherical primary α phase will be dissolved and transformed into the β phase. When the holding time is short, the spherical primary aα phase has not been completely dissolved, but in the dissolved part, there will be residual compositional pockets of the α phase; When the holding time is extended, the α phase will be completely dissolved, but the original α phase area still leaves the residual compositional pockets of the α phase. The gradient microstructure of the present disclosure is achieved by the composition gradient in the β matrix caused by these remaining composition. If the holding time is further extended, the remaining composition of the α phase will diffuse uniformly, and a β matrix with uniform composition will be obtained. In addition, during the aging treatment of titanium alloy forgings, the size of the lamellar α phase is very sensitive to changes in composition, and a small composition change will cause the change of the α lamellar size, which is another reason why the composition gradient can cause the structural gradient. Based on the above findings, the present disclosure designs an ingenious three-step heat treatment scheme, which uses heat preservation treatment to form a composition gradient, and then obtains a gradient microstructure through aging treatment.

In the present disclosure, when the holding time is less than or equal to 1.5 min, the spherical primary α phase has not yet been completely dissolved, and the dissolved part leaves the remaining composition gradient. In the subsequent aging treatment, ultra-fine α lamellae are formed in the composition gradient area, and coarse α lamellae are formed in the beta matrix, combined with the undissolved spherical primary α phase, which is called a gradient tri-modal microstructure.

In the present disclosure, when the holding time is greater than 1.5 min and less than or equal to 10 min, the α phase is completely dissolved, and the area where the α phase originally exists leaves a remaining composition gradient. After the subsequent aging treatment, a combined coarse and ultra-fine α-lamellae, e.g. a gradient lamella microstructure, is obtained. Among them, the formation of ultra-fine α lamellae at the grain boundaries (composition gradient area) can strengthen the grain boundaries and form coarse α lamellae within the grains, which can increase the deformability.

The present disclosure also provides a titanium alloy with a gradient microstructure prepared by the preparation method described in the above scheme; the gradient microstructure is a gradient lamella microstructure or a gradient tri-modal microstructure, and the gradient lamella microstructure is composed of coarse and ultra-fine α-lamellae. The gradient tri-modal microstructure is composed of primary α phase, ultra-fine α phase and coarse α phase. The titanium alloy with a gradient microstructure provided by the present disclosure has good strength and ductility matching, and has excellent mechanical properties. Specifically, when the titanium alloy has a gradient lamella microstructure, the strength of the titanium alloy is 1267-1498 MPa, and the ductility is 5.8-10.2%; when the titanium alloy has a gradient tri-modal microstructure, the strength of the titanium alloy is 1283-1529 MPa, and the ductility is 6.9-12.3%.

The technical schemes of the present disclosure will be clearly and completely described below in conjunction with the embodiments of the present disclosure.

The alloy used in the examples is only Ti-55531 titanium alloy, which belongs to the metastable β-type titanium alloy. The size of the titanium alloy is 68 mm×10 mm×3 mm, and the composition is Ti-5Al-5Mo-5V-3Cr-1Zr. The preparation method is as follows:

(1) Selecting the raw materials required for the titanium alloy, conducting vacuum consumable melting for 3 times;
(2) Subjecting the alloy to a cogging forging at 100° C. above the α/β transition temperature (transition temperature is 840° C.);
(3) Subjecting the alloy to an α/β phase region forging at 100° C. below the α/β transition temperature to obtain the metastable β-type Ti-55531 titanium alloy forgings after three-drawing and three-forging.

EXAMPLE 1

The Ti-55531 titanium alloy (α/β transition temperature of 840° C.) forgings was heat-treated according to the processes in (1), (2), (3), and (4):

(1) 800° C./90 min;
(2) 800° C./90 min+920° C./1 min (holding time after heating up to 920° C.);
(3) 800° C./90 min+920° C./2 min (holding time after heating up to 920° C.);
(4) 880° C./30 min;

Wherein, (1) is to directly treat the Ti-55531 titanium alloy forgings at 800° C. for 90 min, and then air-cool to room temperature; (2) is to treat the Ti-55531 titanium alloy forgings at 800° C. for 90 min, and then heat it at 920° C. for 1 min after air cooling (specifically, placing the Ti-55531 titanium alloy forgings directly at 920° C., heating up to 920° C., and holding for 1 min, the heating rate of Ti-55531 titanium alloy forgings of 1000° C./min, and the heating time is about 1 min, e.g. the total processing time at 920° C. is 2 min), and then air-cool to room temperature; The treatment method of (3) is similar to (2), except that the holding time at 920° C. is different. The holding time at 920° C. is 2 min, the heating time is about 1 min, and the total time is 3 min; (4) is to treat the Ti-55531 titanium alloy forgings directly at 880° C. for 30 min, and then air-cool to room temperature.

Figure 2:
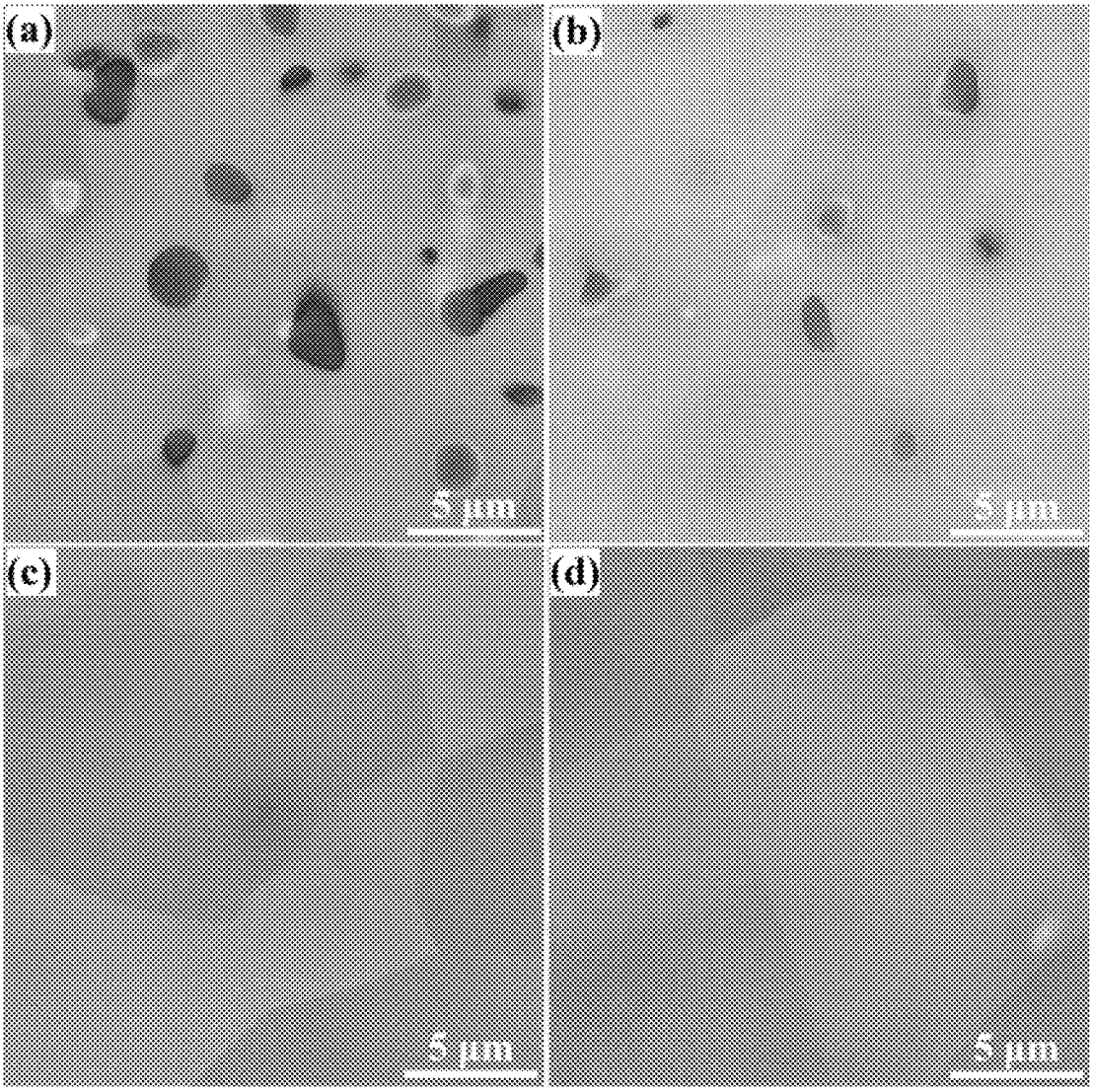
FIG. 2 is a microstructure image of the bimodal microstructure, the gradient tri-modal microstructure, the gradient lamellar microstructure and the uniform lamellar microstructure before the aging treatment in Example 1.

After heat treatment according to the process in (1)-(4), the microstructure of the titanium alloy obtained (the microstructure of the titanium alloy obtained before the aging treatment) is shown in FIG. 2, and panels (a)-(d) in FIG. 2 correspond to the titanium alloy treated in (1)-(4) above. According to FIG. 2, it can be seen that when the alloy is heat-treated below the α/β transition temperature, there are spherical primary α phases and β matrix in the alloy, as shown in panel (a) of FIG. 2; When the temperature of the alloy quickly rises above the α/β transition temperature, the spherical primary α phase will be dissolved and transformed into β phase. When the holding time at the α/β transition temperature is 1 min, the spherical α phase has not completely dissolved, but in the part that has been dissolved, there will be remaining composition of the α phase, as shown in the light gray mark in panel (b) of FIG. 2; When the holding time at the α/β transition temperature is extended to 2 min, the α phase has been completely dissolved, but the original α existing area still leaves the mark of the remaining composition, as shown in panel (c) of FIG. 2. When the alloy is treated in the β single-phase region at 880° C. for 30 min, a β matrix with uniform composition is obtained, as shown in panel (d) of FIG. 2.

Figure 3:
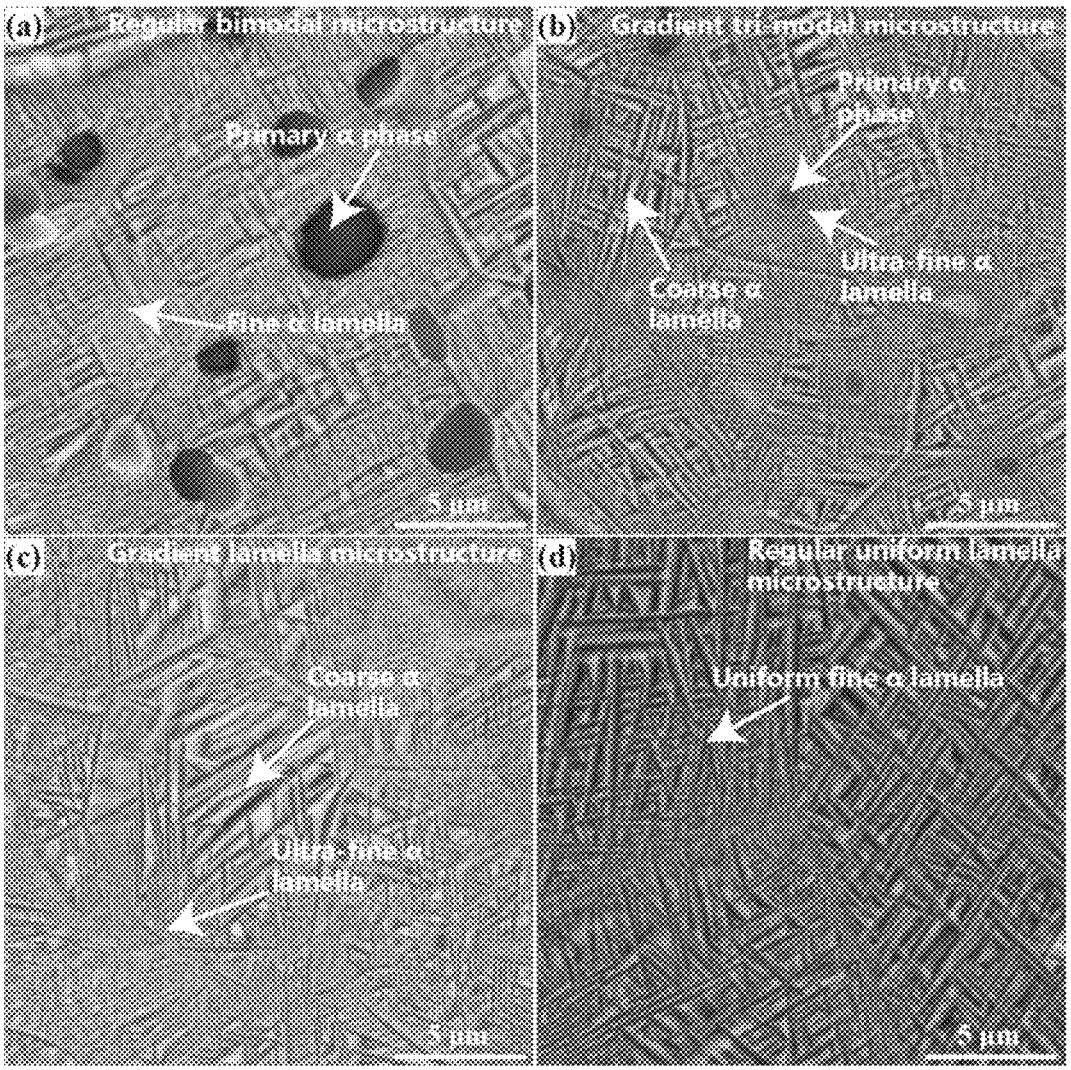
FIG. 3 is a microstructure image of the bimodal microstructure, the gradient tri-modal microstructure, the gradient lamellar microstructure and the uniform lamellar microstructure titanium alloy obtained after the aging treatment in Example 1.

The titanium alloy treated in accordance with the processes in (1)-(4) above was subjected to aging treatment. The temperature of the aging treatment is 600° C. and the time is 120 min. The microstructure of the titanium alloy obtained after the aging treatment is shown in FIG. 3. Wherein, panel (a) is a regular bimodal microstructure, panel (b) is a gradient tri-modal microstructure, panel (c) is a gradient lamellar microstructure, and panel (d) is a regular uniform lamellar microstructure.

During the aging treatment, the size of the lamellar α phase is very sensitive to changes in composition, and a small composition change will cause the size of the α lamella to change. The titanium alloy shown in panel (a) of FIG. 2 undergoes aging treatment to obtain a regular bimodal microstructure, as shown in panel (a) of FIG. 3. When the titanium alloy shown in panel (b) of FIG. 2 is subjected to aging treatment, because there is a composition gradient in the area where the α phase is dissolved, an ultra-fine α lamella is formed around the spherical α phase, and the coarse α lamella phase is formed in other areas to obtain a gradient tri-modal microstructure, as shown in panel (b) of FIG. 3. When the titanium alloy shown in panel (c) of FIG. 2 is subjected to aging treatment, due to the gradient of remaining composition, the aging forms a gradient lamellar microstructure, as shown in panel (c) of FIG. 3. In the titanium alloy shown in panel (d) of FIG. 2, since the β matrix composition is uniform, a uniform lamellar microstructure is obtained after aging, as shown in panel (d) of FIG. 3.

After aging treatment at 600° C., the above heat treatment processes (1)-(4) can be expressed as:

(1) Bimodal microstructure: 800° C./90 min+600° C./120 min;

(2) Gradient tri-modal microstructure: 800° C./90 min+920° C./1 min+600° C./120 min;

(3) Gradient lamellar microstructure: 800° C./90 min+920° C./2 min+600° C./120 min;

(4) Uniform lamellar microstructure: 880° C./30 min+600° C./120 min;

The above titanium alloy after heat treatment was used to prepare tensile test specimens for tensile testing. The results are shown in Table 1.

TABLE 1

Comparison of tensile properties of bimodal microstructure, gradient tri-modal microstructure, uniform lamellar microstructure, and gradient lamellar microstructure

| microstructure of alloy | bimodal microstructure | gradient tri-modal microstructure | uniform lamellar microstructure | gradient lamellar microstructure |
|---|---|---|---|---|
| heat treatment scheme | 800° C./90 min + 600° C./120 min | 800° C./90 min + 920° C./1 min + 600° C./120 min | 880° C./30 min + 600° C./120 min | 800° C./90 min + 920° C./2 min + 600° C./120 min |
| strength | 1209 MPa | 1307 MPa | 1220 MPa | 1286 MPa |
| ductility | 12.50% | 10.90% | 4.90% | 10.10% |

According to the data in Table 1, the difference between the bimodal microstructure and the gradient tri-modal microstructure of the heat treatment scheme is that a step of heat preservation treatment at 920° C. for 1 min is added in the present disclosure. This optimized scheme makes the alloy microstructure change significantly, and the strength of the alloy is increased from 1209 MPa to 1307 MPa, and the ductility of the alloy remains at 10.9%, which has a more excellent comprehensive performance.

The difference between the heat treatment scheme of uniform lamellar microstructure and gradient lamellar microstructure is as follows: the temperature and time of solution treatment are changed, the step of heat treatment at 920° C. is added, the holding time at 920° C. is extended to 2 min, the alloy has a gradient lamellar microstructure that is different from the regular uniform lamellar microstructure, the strength of the alloy is increased from 1220 MPa to 1286 MPa, the ductility of the alloy is increased from 4.9% to 10.1%, and the overall performance is significantly improved.

EXAMPLE 2

The other conditions are the same as in Example 1, except that the treatment temperature is changed. The specific treatment process is as follows:

Bimodal microstructure: 800° C./90 min+500° C./120 min; Gradient tri-modal microstructure: 800° C./90 min+920° C./1 min+500° C./120 min; Uniform lamellar microstructure: 880° C./30 min+500° C./120 min; Gradient lamellar microstructure: 800° C./90 min+920° C./2 min+500° C./120 min;

Wherein, the treatment time at 920° C. refers to the holding time after the titanium alloy is heated to 920° C., and the heating rate is the same as in Example 1.

The above titanium alloy after heat treatment was used to prepare tensile test specimens for tensile testing. The results are shown in Table 2.

TABLE 2

Comparison of tensile properties of bimodal microstructure, gradient tri-modal microstructure, uniform lamellar microstructure, and gradient lamellar microstructure

| micro-structure of alloy | bimodal micro-structure | gradient tri-modal microstructure | uniform lamella microstructure | gradient lamella structure |
|---|---|---|---|---|
| heat treatment scheme | 800° C./90 min + 500° C./ 120 min | 800° C./90 min + 920° C./ 1 min + 500° C./ 120 min | 880° C./30 min + 500° C./ 120 min | 800° C./90 min + 920° C./ 2 min + 500° C./120 min |
| strength | 1447 MPa | 1529 MPa | 1462 MPa | 1496 MPa |
| ductility | 8.40% | 7.10% | 2.60% | 5.80% |

According to the data in Table 2, it can be seen that compared with the bimodal microstructure, the strength of the gradient tri-modal microstructure of the present disclosure is significantly improved, while the elongation is maintained at 7.1%; compared with the uniform lamellar microstructure, the strength and ductility of the gradient lamellar microstructure are improved, and the overall performance of the alloy is significantly improved.

EXAMPLE 3

The other conditions are the same as in Example 1, except that the treatment temperature is changed. The specific treatment process is as follows:

Bimodal microstructure: 775° C./90 min+600° C./120 min;

Gradient tri-modal microstructure: 775° C./90 min+920° C./1 min+600° C./120 min;

Uniform lamellar microstructure: 880° C./30 min+600° C./120 min;

Gradient lamellar microstructure: 775° C./90 min+920° C./2 min+600° C./120 min;

Wherein, the treatment time at 920° C. refers to the holding time after the titanium alloy is heated to 920° C., and the heating rate is the same as in Example 1.

The above titanium alloy after heat treatment was used to prepare tensile test specimens for tensile testing. The results are shown in Table 3.

TABLE 3

Comparison of tensile properties of bimodal microstructure, gradient tri-modal microstructure, uniform lamellar microstructure, and gradient lamellar microstructure

| microstructure of alloy | bimodal microstructure | gradient tri-modal microstructure | uniform lamellar microstructure | gradient lamellar microstructure |
|---|---|---|---|---|
| heat treatment scheme | 775° C./30 min + 600° C./120 min | 775° C./90 min + 920° C./1 min + 600° C./120 min | 880° C./30 min + 600° C./120 min | 775° C./90 min + 920° C./2 min + 600° C./120 min |
| strength | 1168 MPa | 1283 MPa | 1220 MPa | 1267 MPa |
| ductility | 14.8% | 12.3% | 4.9% | 10.2% |

According to the data in Table 3, it can be seen that compared with the bimodal microstructure, the strength of the gradient tri-modal microstructure of the present disclosure is significantly improved, and at the same time the ductility is maintained at 12.3%; compared with the uniform lamellar microstructure, both the strength and ductility of the gradient lamellar microstructure are improved, especially the ductility is significantly improved, and the alloy has better comprehensive performance.

EXAMPLE 4

The other conditions are the same as in Example 1, except that the treatment temperature is changed. The specific treatment process is as follows:

Bimodal microstructure: 775° C./90 min+500° C./120 min;

Gradient tri-modal microstructure: 775° C./90 min+920° C./1 min+500° C./120 min;

Uniform lamellar microstructure: 880° C./30 min+500° C./120 min;

Gradient lamellar microstructure: 775° C./90 min+920° C./2 min+500° C./120 min;

Wherein, the treatment time at 920° C. refers to the holding time after the titanium alloy is heated to 920° C., and the heating rate is the same as in Example 1.

The above titanium alloy after heat treatment was used to prepare tensile test specimens for tensile testing. The results are shown in Table 4.

TABLE 4

Comparison of tensile properties of bimodal microstructure, gradient tri-modal microstructure, uniform lamellar microstructure, and gradient lamellar microstructure

| micro-structure of alloy | bimodal micro-structure | gradient tri-modal microstructure | uniform lamellar microstructure | gradient lamellar microstructure |
|---|---|---|---|---|
| heat treatment scheme | 775° C./90 min + 500° C./ 120 min | 775° C./90 min + 920° C./ 1 min + 500° C./120 min | 880° C./30 min + 500° C./ 120 min | 775° C./90 min + 920° C./ 2 min + 500° C./120 min |
| strength | 1431 MPa | 1513 MPa | 1462 MPa | 1498 MPa |
| ductility | 8.80% | 6.90% | 2.60% | 6.10% |

According to the data in Table 4, it can be seen that compared with the bimodal microstructure, the strength of the gradient tri-modal microstructure of the present disclosure is significantly improved, and at the same time the ductility is maintained at 6.9%; compared with the uniform lamellar microstructure, both the strength and ductility of the gradient lamellar microstructure are improved, especially the ductility is significantly improved, which is increased from 2.6% to 6.1%, and the alloy has better comprehensive performance.

It can be seen from the above examples that after the metastable β-type titanium alloy forgings undergoes the three-step heat treatment of the present disclosure, the gradient lamellar microstructure and the gradient tri-modal microstructure are obtained in the titanium alloy for the first time. Compared with the uniform lamellar microstructure and the bimodal microstructure, the microstructure of the alloy is significantly changed, and the overall performance is significantly improved.

The above are only the preferred embodiments of the present disclosure. It should be pointed out that for those of ordinary skill in the art, without departing from the principle of the present disclosure, several improvements and modifications can be made, and these improvements and modifications also should be regarded as the protection scope of the present disclosure.

What is claimed is:

1. A method for preparing a titanium alloy with a gradient microstructure, comprising the following steps:

successively subjecting a metastable β-type titanium alloy forgings to solution treatment, heat preservation treatment and aging treatment to obtain a titanium alloy with a gradient microstructure, wherein a temperature of the solution treatment is 20-100° C. below the α/β transition temperature of a metastable β-type titanium alloy in the metastable β-type titanium alloy forgings, and a time is 30-120 min;

a temperature of the heat preservation treatment is 30-100° C. above the α/β transition temperature of the metastable β-type titanium alloy, and a holding time is less than or equal to 1.5 min or greater than 1.5 min and less than or equal to 10 min; and timing is started when the temperature of the metastable β-type titanium alloy forgings is raised to the temperature of the heat preservation treatment; and when the holding time is less than or equal to 1.5 min, the gradient microstructure is a gradient tri-modal microstructure; when the holding time is greater than 1.5 min and less than or equal to 10 min, the gradient microstructure is a gradient lamellar microstructure.

2. The method according to claim 1, wherein the heat preservation treatment comprises the following steps: directly placing a titanium alloy forgings obtained after solution treatment at the temperature of the heat preservation treatment, and starting timing when the titanium alloy forgings is heated to the temperature of the heat preservation treatment.

3. The method according to claim 2, wherein a heating rate of the titanium alloy forgings to the temperature of the heat preservation treatment is 200-2000° C./min.

4. The method according to claim 1, wherein a temperature of the aging treatment is 400-680° C., and a time is 60-600 min.

5. The method according to claim 1, wherein the metastable β-type titanium alloy is one of Ti-55531 alloy, Ti-1023 alloy, and β-21S alloy.

6. The method according to claim 1, wherein the metastable β-type titanium alloy forgings is prepared by a method comprising the following steps:

mixing titanium alloy raw materials, smelting, casting and scalping to obtain titanium alloy ingots; and subjecting the titanium alloy ingots to a cogging forging and an α/β phase region forging in sequence to obtain the metastable β-type titanium alloy forgings, wherein the temperature of the cogging forging is 100-200° C. above the α/β transition temperature of the metastable β-type titanium alloy; and the temperature of the α/β phase region forging is 20-100° C. below the α/β transition temperature.

7. The method according to claim 6, wherein the smelting is conducted by a vacuum consumable smelting, and times of the vacuum consumable smelting are at least 3 times.

8. The method according to claim 6, wherein times of the α/β phase region forging are at least 3 times.

* * * * *